United States Patent [19]

Wagner et al.

[11] Patent Number: 4,543,013

[45] Date of Patent: Sep. 24, 1985

[54] GROUNDWATER PROTECTION SYSTEM

[75] Inventors: Louis E. Wagner, Eggertsville, N.Y.; Harold F. Flannery, Batavia, Ohio; Randolph W. Rakoczynski, Grand Island, N.Y.

[73] Assignee: Environmental Design, Inc., Palm Beach, Fla.

[21] Appl. No.: 550,781

[22] Filed: Nov. 14, 1983

Related U.S. Application Data

[63] Continuation-in-part of Ser. No. 324,067, Nov. 23, 1981.

[51] Int. Cl.[4] ..... E02D 3/00; E02B 3/16

[52] U.S. Cl. ..... 405/128; 405/53; 210/170

[58] Field of Search ..... 405/128, 129, 130, 52, 405/53; 210/747, 170, 284

[56] References Cited

U.S. PATENT DOCUMENTS

| | | | |
|---|---|---|---|
| 3,425,555 | 2/1969 | Ridgeway | 405/258 |
| 3,505,820 | 4/1970 | Draper et al. | 405/53 |
| 3,595,397 | 7/1971 | Abos | 210/284 X |
| 3,757,954 | 9/1973 | Toth | 210/284 X |
| 4,048,068 | 9/1977 | Hirs | 210/284 X |
| 4,194,855 | 3/1980 | Egger | 405/128 |
| 4,326,963 | 4/1982 | Watson et al. | 210/284 X |
| 4,352,601 | 10/1982 | Valiga et al. | 405/128 X |
| 4,448,690 | 5/1984 | Maphis | 405/128 X |
| 4,451,173 | 5/1984 | Watson et al. | 405/53 |

*Primary Examiner*—Dennis L. Taylor

*Attorney, Agent, or Firm*—Michael L. Dunn; William H. Holt

[57] ABSTRACT

A groundwater protection system is provided for a surface impoundment or landfill wherein contaminated material is contained in a first compartment. A second compartment is located beneath the first compartment and contains a plurality of treatment materials for acting upon leakage from the first compartment. Treated leakage is collected by a drain system and is recovered therefrom for subsequent treatment and/or disposal.

15 Claims, 1 Drawing Figure

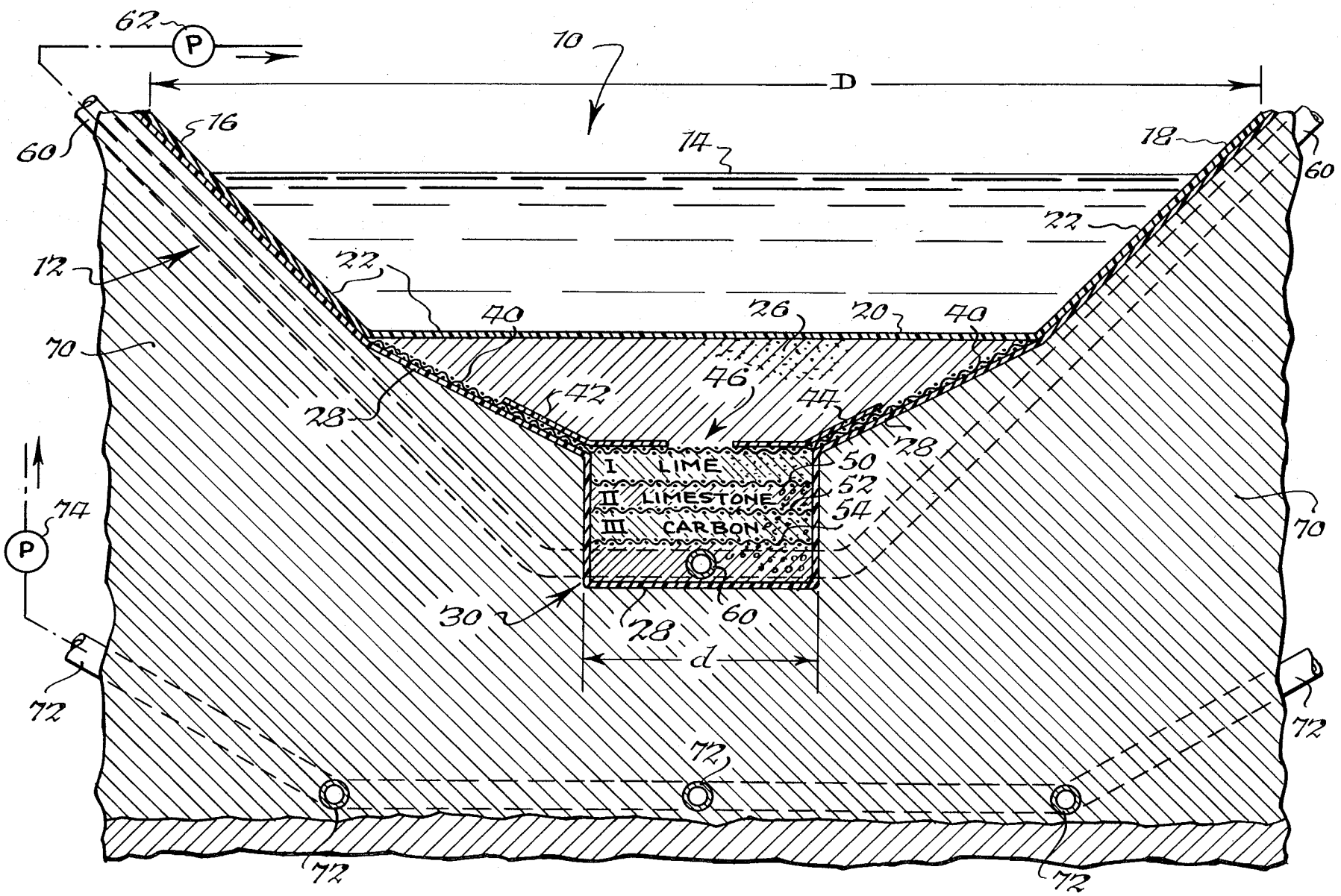
LIME
LIMESTONE
CARBON
I
II
III
D
d
P
P

GROUNDWATER PROTECTION SYSTEM

CROSS-REFERENCE TO RELATED APPLICATION

This is a continuation-in-part of U.S. patent application Ser. No. 324,067, filed on Nov. 23, 1981.

SUMMARY OF THE INVENTION

1. Field of the Invention

This invention relates to a new and useful groundwater protection system useful with surface impoundments such as pits, ponds or lagoons and landfills and, more particularly, to a groundwater protection system provided with an in-situ treatment system for leachate or leakage and a recovery system for the treated leachate or leakage.

2. Brief Description of the Invention

The present invention concerns a groundwater protection system comprising a first compartment for receiving contaminated material, a second compartment underlying the first compartment and containing treatment material for treating any leakage which may escape from the first compartment. The invention also concerns a groundwater protection system comprising a holding compartment, a substantially liquid impervious liner disposed beneath the compartment, and an in-situ leakage treatment system below the liner. The type of treatment material is particularly selected in view of the waste material for which the impoundment or landfill is designed. As a result, any leakage from the primary holding compartment is directed to pass through the treatment compartment and thereby lessen the toxicity or hazardous nature of the leakage. A drain system is provided to recover the treated leakage for further treatment and/or disposal.

3. History of the Prior Art

In the prior art, disposal of chemical waste, and particularly hazardous chemical waste, posed a particularly difficult problem. Originally, there was little concern about the disposal of such chemical waste and such wastes were simply discharged to bodies of water or were buried without concern for subsequent migration of the chemicals.

It later became apparent that care was required in disposing of such waste material. Chemical wastes were frequently disposed of by placing them in a semi-secure landfill or a surface impoundment which was lined with water impermeable clay. Such landfills and surface impoundments were still not considered adequate for particularly hazardous chemical wastes which were frequently disposed of by constructing concrete vaults in which the waste materials were deposited or by imbeding drums or other containers containing the materials in concrete.

Secure landfills or surface impoundments were then designed which contained water impervious liners or films in addition to liners of clays or cement layers.

Even these landfills and surface impoundments would occasionally leak thus creating leachates which contain chemical waste materials which could enter natural water supplies.

Examples of such lined landfills are shown in U.S. Pat. Nos. 4,166,709; 3,732,697 and 3,586,624.

In order to overcome the problem of leachates, leachate collection systems were devised in order to collect leachates from the landfill and store or treat them so that the leachates could not enter natural water supplies. Examples of such leachate collection systems are described in U.S. Pat. Nos. 3,705,851 and 4,171,921. Such a system is also shown in an article in *Newsweek Magazine,* Mar. 2, 1981 at page 67.

BRIEF DESCRIPTION OF THE DRAWING

The FIGURE is a vertical sectional view of a surface impoundment comprising a groundwater protection system including a leakage treatment compartment, and a primary and secondary drain system.

DETAILED DESCRIPTION OF THE INVENTION

A surface impoundment, generally indicated by the numeral 10, includes a first holding compartment 12 which is shown as containing liquid waste material 14. It is to be understood that the impoundment 10 may, however, be considered as a landfill and be used for receiving solid materials, or a mixture of solid and liquid materials, sludges, and the like. The first compartment 12 is defined by downwardly converging walls 16 and 18 and generally horizontally disposed bottom 20 all of which are constructed or defined by a liner 22. Liner 22 may be manufactured of any suitable material and is usually of flexible material which does not crack or degrade under use conditions including the pressure, temperature and chemical exposure to which the liner is subjected. Many plastic films have been found suitable for this purpose including polyvinyl and polyolefin films. Particular examples of such liners are those manufactured of polyvinyl chloride, polyethylene and polypropylene. The term "do not degrade", as used herein, means that the film remains impervious to water or other liquids for perhaps as long as ten years and, preferably, for even longer periods of time.

A bed of granular media 26 is provided beneath the bottom 20 of the first compartment 12, the bed being defined by a secondary liner 28 which may extend upwardly beneath the walls 16 and 18 to underly the primary liner 22 such that any leakage escaping from liner 22 will be directed downwardly and inwardly toward the bed of granular media 26. The secondary liner is similar to and may be constructed from any of the materials mentioned above with regard to the construction of primary liner 22. Secondary liner 28 continues across the bottom of the bed 26 and is recessed to define a second or treatment compartment, generally indicated by the numeral 30. Treatment compartment 30 is shown as being subdivided into a plurality of smaller compartments identified by the numerals I, II and III. It is to be understood that more, or less, sub-compartments may be provided depending upon the material contained in surface impoundment or landfill 10 and treatment materials to be contained within the treatment compartment 30. Compartment 30, and the treatment materials contained therein, provide an in-situ treatment system. The treatment materials are chosen to react with at least some of the chemical components in leakage which may escape from compartment 12 and which leakage is directed into the compartment 30 by the secondary liner 28. Suitable treatment materials include, amongst others, lime, limestone, powdered or granular activated carbon, ion exchange resins, molecular sieve material, and crystals of ferrous sulfate. Generally speaking, lime can be used for treating leakage containing heavy metals since lime will precipitate such metallic contaminants which then become trapped in the lime. Crushed limestone may be used as a treatment material for leachate containing amphoteric metals thus limiting the mobility of such materials. Powdered or granular activated carbon has ability to adsorb toxic, high molecular weight organic contaminants which are likely to be present in leakage from organic materials such as organic flammable materials and organic toxic materials. Carbon is also useful to adsorb residual, trace levels of various metallic ions and can therefore be used to treat leakage which contains metallic materials. Ion exchange resins and molecular seive material may be used immediately above or below layers of carbon. Crystals of ferrous sulfate may be used if needed to reduce hexavalent chromium and, for this purpose, would usually be disposed above a layer of lime. It is to be understood that the showing in the drawing of compartments I, II and III are merely illustrative examples of the sequence of materials through which leakage is induced to pass through.

In order to particulary direct leakage into the treatment compartment 30, a layer of a porous or foraminous fabric 40 underlys the bed of granular media 26. Fabric 40, sometimes called geotextile fabric, is usually constructed of a synthetic material such as polypropylene, polyethylene, etc. and is chosen with consideration being given to the type of leachate which may escape from compartment 12. Fabric 40 may be, for example, spun or woven and have openings of U.S. Standard Sieve size of, perhaps, 50 to 100. The fabric 40 is preferably disposed over secondary liner 28 to provide protection thereof from the granular media contained in bed 26. The porous nature of fabric 40 allows leakage to pass from bed 26 into the treatment compartment 30 for sequential passage through the treatment materials contained in sub-compartments I, II and III etc. As is illustrated in the drawing, it may be desirable to provide flow control liners 42 and 44 in spaced relation to provide a flow opening, generally indicated by the numeral 46, to direct a limited flow of leakage through a somewhat central portion of the treatment materials. Liners 42 and 44 are preferably non-porous and may be constructed of materials similar to that used for liners 22 and 28. Geotextile fabric is also used to separate the various layers of treatment material as is shown by fabric layers 50, 52 and 54. These layers of fabric may be spun or woven to provide openings capable of passing, for example, 300 to 400 gallons of liquid per minute per square foot of fabric. Such flow rates are, of course, reduced by the presence of the granular media in bed 26 and treatment materials 50, 52 and 54.

From the foregoing description, it will be apparent that any leakage escaping from the primary holding compartment 12 will be constrained by secondary liner 28 thus causing such leakage to pass through the bed of granular media 26, through opening 46 and through the superposed discrete layers of treatment material contained within the treatment compartment 30. The bed of granular material or media 26 may be constructed of various particulate material such as sand, gravel, crushed stone and mixtures thereof. Fabric 40 provides the dual function of constraining such particulate material to remain in the bed 26 and also protects or cushions liner 28 from such particulate material.

Treated leakage is removed from treatment compartment 30 by way of a drain system which may, include a series of pipes 60 and a suitable pump 62. In order to be substantially leakproof, the surface impoundment or landfill 10 is usually provided with a layer or layers of liquid impermeable clay disposed throughout the complete underside of surface impoundment or landfill 10, the various clay layers being generally defined by the numerals 70. It may also be desirable to provide a secondary drain system beneath the clay layers 70, the secondary drain system including various drain pipes 72 connected to a suitable pump 74.

It is generally understood that surface impoundments or landfills of the type described above may vary greatly in depth and area covered. Depth may range, for example, from 3 feet to, perhaps, 20 feet while the area may be, for example, as large as perhaps 2 to 20 acres, or more. It is to be noted in the drawing that the upper-most dimension of the impoundment or landfill 10 is indicated by a dimension "D" while the comparable dimension of the treatment compartment 30 is indicated by the letter "d". In view of the downwardly converging sides of the compartment 12 and the downwardly coverging sides of the bed of granular media 26 the dimension "d" is substantially less than the dimension "D" such that the area occupied by compartment 30 is considerably less than the uppermost surface area of the first compartment 12. The uppermost surface area of treatment compartment 30 may be, for example, within a range of only 5% to 20% of the uppermost surface area of the first compartment 12. As a result of this construction, it will be seen that the layers of various treatment materials are restricted to a generally small volume whereas, otherwise, layers of treatment material, which are sometimes quite expensive, would have to extend completely across the bottom of the impoundment or landfill 10.

From the foregoing, it will be seen that there has been disclosed a preferred embodiment of a groundwater protection system which provides advantages not heretofore found in the prior art; the spirit and scope of the invention is, however, not to be restricted by the description of the preferred embodiment but only by the spirit and scope of the invention as defined in the appended claimed subject matter.

We claim:

1. A groundwater protection system comprising an impoundment for receiving and storing hazardous industrial wastes for subsequent treatment and disposal of said wastes, said impoundment comprising a first compartment for receiving said hazardous industrial wastes, a second compartment underlying said first compartment and containing reactive treatment material for treating any leakage which may escape from said first compartment, and means for substantially restricting migration of leakage from said first compartment to said second compartment, said means including a liner constructed of material substantially impervious to the passage of said leakage and being located between said first compartment and said second compartment.

2. A groundwater protection system as defined in claim 1 wherein said liner is comprised of a sheet of thermoplastic material.

3. A groundwater protection system as defined in claim 1 wherein said reactive treatment material is comprised of a plurality of different materials, and each of said different materials being capable of providing a different treatment to said leakage for treating the higher concentrations and broader range of contaminants commonly associated with said hazardous industrial wastes.

4. A groundwater protection system as defined in claim 3 wherein said different materials are disposed in superposed discrete layers, and a foraminous fabric being disposed between and separating said layers, whereby said leakage passes sequentially through said layers.

5. A groundwater protection system as defined in claim 4 wherein at least one of said different materials is selected from lime, limestone, carbon, ion exchange resins, ferrous sulphate and molecular sieve material.

6. A groundwater protection system as defined in claim 5 wherein a drain system is provided, said drain system being disposed for collecting treated leakage from said second compartment.

7. A groundwater protection system as defined in claim 6 wherein said second compartment is considerably smaller in area than is said first compartment.

8. A groundwater protection system as defined in claim 1 wherein said second compartment is disposed below and spaced from said first compartment, granular media disposed between and separating said first compartment and said second compartment, said liner being disposed between said first compartment and said granular media for retarding flow of leakage from said first compartment into said granular media, and a substantially liquid impervious second liner means disposed substantially beneath said granular media and above said second compartment for collecting leakage passing through said granular media and directing said leakage into said second compartment.

9. A groundwater protection system as defined in claim 8 wherein said reactive treatment material is comprised of a plurality of different materials, and each of said different materials being capable of providing a different treatment to said leakage for treating the higher concentrations and broader range of contaminants commonly associated with said hazardous industrial wastes.

10. A groundwater protection system as defined in claim 9 wherein said different materials are disposed in superposed discrete layers, and a foraminous fabric being disposed between and separating said layers, whereby said leakage passes sequentially through said layers.

11. A groundwater protection system as defined in claim 10 wherein at least two of said different materials are selected from lime, limestone, carbon, ion exchange resins, ferrous sulphate and molecular sieve material.

12. A groundwater protection system as defined in claim 11 wherein a drain system is provided, said drain system being disposed for collecting treated leakage from said second compartment.

13. A groundwater protection system as defined in claim 12 wherein said first compartment and said second compartment each has an uppermost surface area, the uppermost surface area of said second compartment being within a range of 5% to 20% of the uppermost surface area of said first compartment.

14. A groundwater protection system comprising a holding compartment, a substantially liquid impervious liner disposed beneath said compartment, and an in-situ leakage treatment system beneath said liner, said in-situ treatment system including a second compartment disposed beneath and in spaced relation to said holding compartment, reactive treatment material contained within said second compartment for treating leakage escaping from said holding compartment, granular media disposed between said holding compartment and said second compartment, said granular media having sloping sides converging downwardly, a liquid impervious liner means for directing leakage from said granular media into said second compartment, and a drain means connected to said second compartment for removing leakage therefrom after said leakage has been treated by said reactive treatment material.

15. A groundwater protection system as defined in claim 5 wherein said different materials consist of lime, limestone and carbon, and said leakage passes sequentially through said lime, then through said limestone and then through said carbon.

* * * * *